US010559234B1

(12) United States Patent
Younse et al.

(10) Patent No.: US 10,559,234 B1
(45) Date of Patent: Feb. 11, 2020

(54) SURFACE-VARIABLE PIXILATED VISUAL BLOCK DISPLAY SYSTEM

(71) Applicants: Noa Weng Younse, Brooklyn, NY (US); Jennifer Michelle Hiser, Brooklyn, NY (US)

(72) Inventors: Noa Weng Younse, Brooklyn, NY (US); Jennifer Michelle Hiser, Brooklyn, NY (US)

( * ) Notice: Subject to any disclaimer, the term of this patent is extended or adjusted under 35 U.S.C. 154(b) by 0 days.

(21) Appl. No.: 16/358,783

(22) Filed: Mar. 20, 2019

(51) Int. Cl.
*G09F 11/02* (2006.01)

(52) U.S. Cl.
CPC ..... *G09F 11/02* (2013.01)

(58) Field of Classification Search
USPC ..... 434/403
See application file for complete search history.

(56) References Cited

U.S. PATENT DOCUMENTS 176,144 A * 4/1876 McDougall ..... A63F 9/0098 273/282.1
3,706,148 A * 12/1972 Johnston ..... G09F 9/37 40/505
3,987,558 A * 10/1976 Tsukamoto ..... A63H 33/22 434/96
4,898,560 A * 2/1990 Moscovich ..... A63F 9/0613 359/850
5,412,891 A * 5/1995 Black ..... G09F 11/025 40/447
9,858,827 B2 * 1/2018 Shirvani ..... G09B 1/36

* cited by examiner

*Primary Examiner* — Kristina N Junge
(74) *Attorney, Agent, or Firm* — Angus C. Fox, III

(57) ABSTRACT

A surface-variable pixilated visual block display system includes a pegboard having a regular array of apertures, arranged in perpendicular rows and columns, and a plurality of blocks, each of which has six faces. A generally square base face is equipped with a central peg having an axis that is normal to that face, and that fits within any of the apertures. The base face is surrounded by four intersecting quadrilateral side faces. A sixth generally rectangular top face, which intersects the side faces, is non-parallel to the base face. It is contemplated that the blocks can be colored differently. Intersecting edges of the faces are preferably radiused and corners of the block are preferably double radiused. Pegboard apertures are spaced so that each block can spin about the peg axis without physically touching adjacent blocks whose side faces are either mutually perpendicular or mutually parallel.

19 Claims, 9 Drawing Sheets

SURFACE-VARIABLE PIXILATED VISUAL BLOCK DISPLAY SYSTEM

FIELD OF THE INVENTION

The present invention relates, generally, to pixelated visual displays, and, more particularly, to a wall-mounted peg board on which can be installed a plurality of blocks, which are representative of pixels.

BACKGROUND OF THE INVENTION

With the advent of television in the late 1930s, a succession of images were produced with a raster scanning television camera. Transmitted to television viewers as analog radio signals, the images were recreated by a synchronized raster scanning cathode ray whose beam impinged on the back side of a vacuum tube covered with fluorescent dots. Each dot provided a single element of the recreated images. In digital imaging, a pixel is a physical point in a raster image, or the smallest addressable element in an all points addressable display device. Thus, it is the smallest controllable element of a picture represented on a screen. The word "pixel" is a portmanteau of pix (from "pictures", shortened to "pics") and el (for "element"). The word was first published in 1965 by Frederic C. Billingsley of JPL, to describe the picture elements of video images from space probes to the Moon and Mars. Billingsley claimed to have learned the word from Keith E. McFarland, at the Link Division of General Precision in Palo Alto, who in turn said he did not know where it originated. McFarland said simply it was "in use at the time" (circa 1963).

Although there remain some very vocal analog holdouts in audio and photography who insist that vinyl records and film are respectively better reproduction media, we now live in a world that is largely digital. By failing to anticipate the rapid transition to digital photography, while at the same time attempting to maintain its virtual monopoly on the film photography market, Kodak Corporation was forced to file for bankruptcy protection in January 2012. Although the company has since emerged from bankruptcy, it is now only a shadow of what it was in its glory days during most of the twentieth century.

Very large, freeway signboard size flat panel displays are now used extensively for advertising in large cities. Such flat panel displays are even more ubiquitous in present-day China. These, of course, are digital displays in which all pixels are addressable. The displays are capable of displaying graphic images in either still or video format.

SUMMARY OF THE INVENTION

The present invention provides a surface-variable pixilated visual block display system that includes a pegboard having an array of apertures, arranged in perpendicular rows and columns, and a plurality of blocks, each of which has six faces. A generally square base face is equipped with a central peg having an axis that is normal to that face, and that fits within any of the apertures. The base face is surrounded by four intersecting quadrilateral side faces. A sixth generally rectangular top face, which intersects the side faces, is non-parallel to the base face. Thus, two parallel, non-adjacent side faces are rectangular, while the other two parallel side faces are trapezoidal. It is contemplated that the blocks can be colored differently. For a preferred embodiment of the invention, the intersecting edges of the faces are radiused so that quarter-cylindrical surfaces are formed.

Corners of the block are also radiused so that partial cylindrical surfaces are formed. The apertures of the pegboard are spaced so that each block can spin about the peg axis without physically touching adjacent blocks whose side faces are mutually perpendicular. There is a slight taper to both the block and to the peg, in the opposite direction, so that the block can be injection molded and subsequently removed from the mold without damage. A two-degree angle is generally accepted as a standard angle for the injection molding of thermoplastic resins. Thus, each of the four side faces makes an angle of 88 degrees from the axis of the peg. If a cross section were to be taken of the peg through its axis, the resulting figure would be a trapezoid with 88-degree angles formed with the base face.

DESCRIPTION OF THE PREFERRED EMBODIMENT

Figure 1:
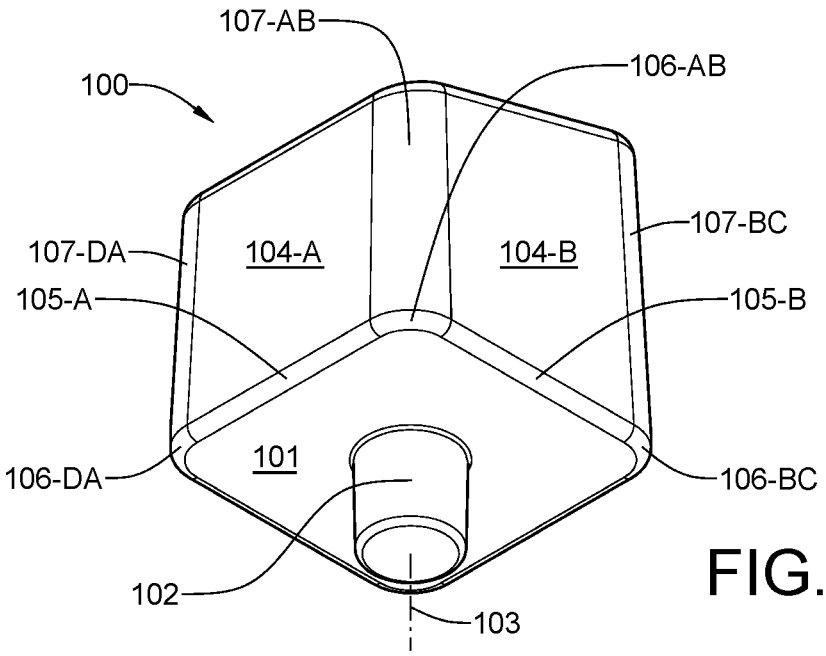
FIG. 1 is an isometric view of a single block.
Figure 2:
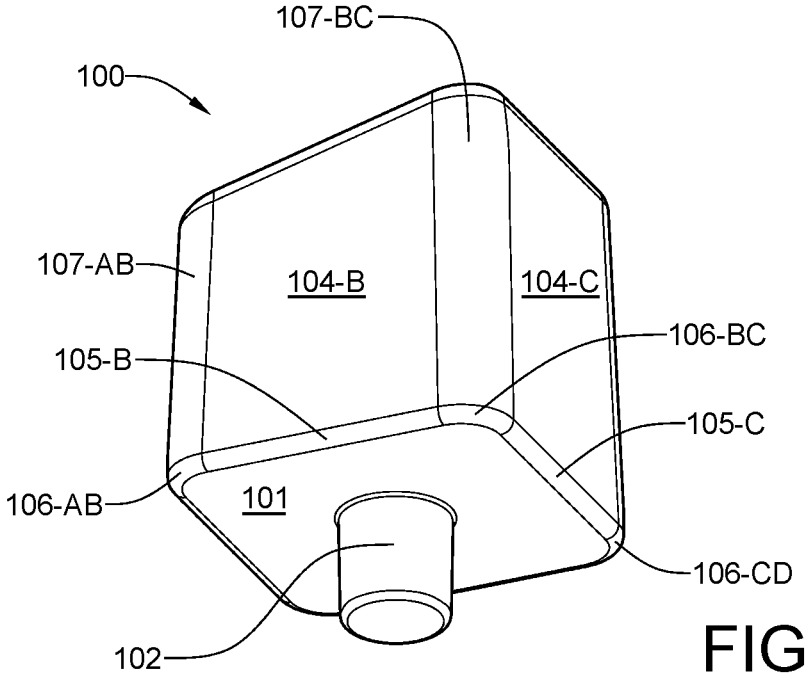
FIG. 2 is an alternative isometric view of the block of FIG. 1.
Figure 3:
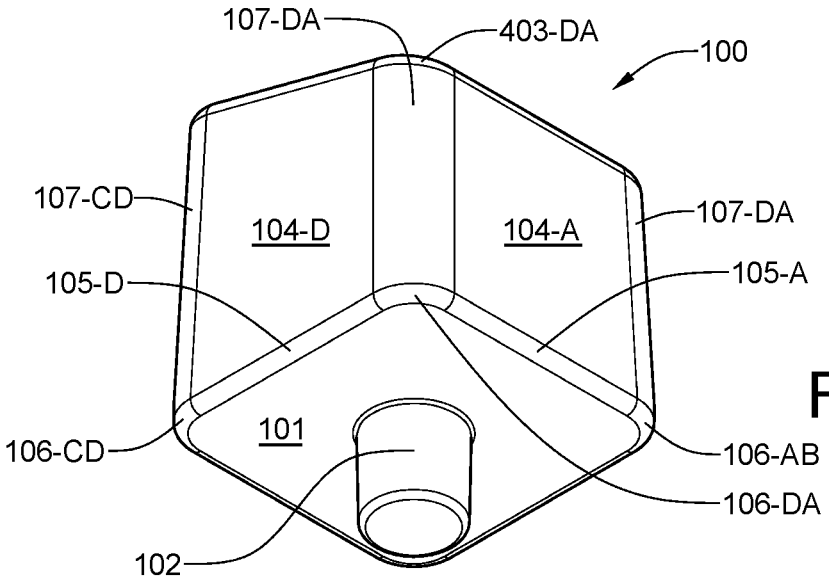
FIG. 3 is another alternative isometric view of the block of FIG. 1.
Figure 4:
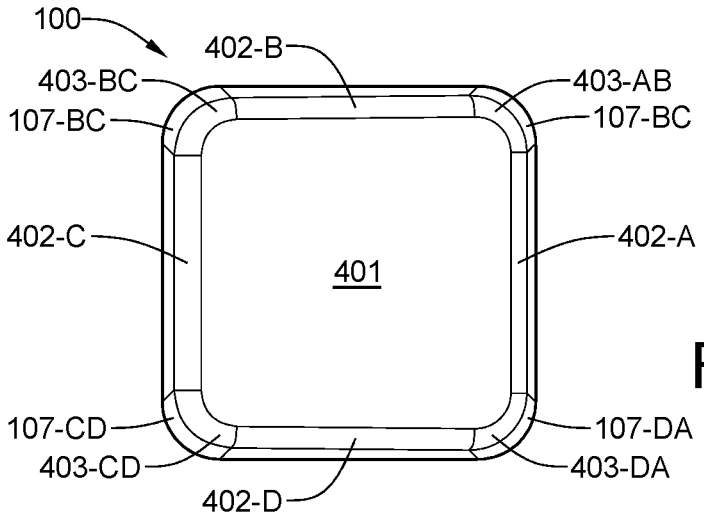
FIG. 4 top plan view of the block of FIG. 1, showing the generally rectangular top face.
Figure 5:
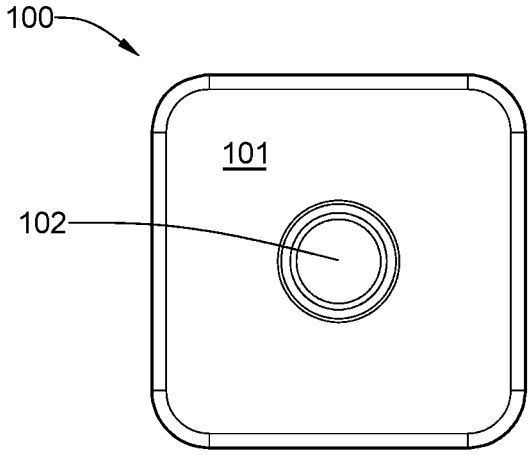
FIG. 5 is a bottom plan view of the block of FIG. 1, showing the base face and the central peg.
Figure 6:
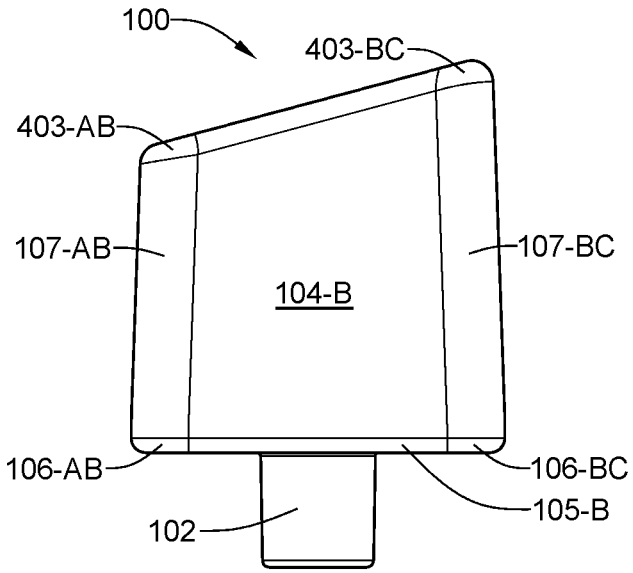
FIG. 6 is a side elevational view of the block of FIG. 1, showing one of the generally trapezoidal faces.
Figure 7:
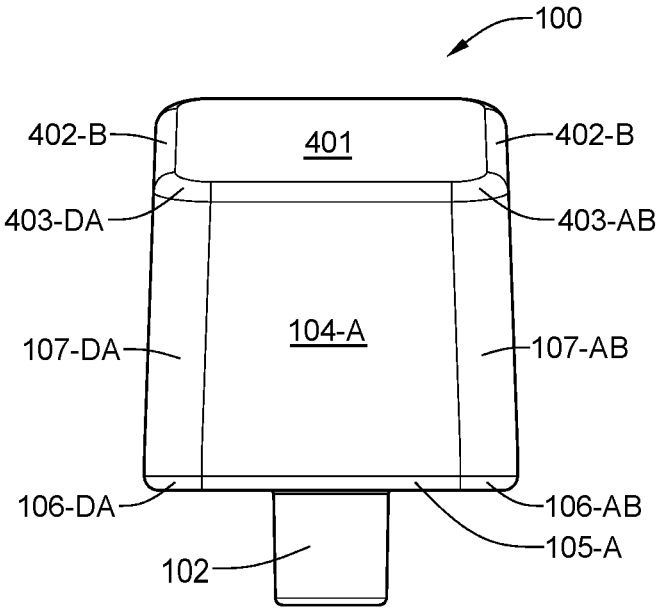
FIG. 7 is a side elevational view of the block of FIG. 1, showing the smaller of the two generally rectangular side faces and the top generally rectangular face.
Figure 8:
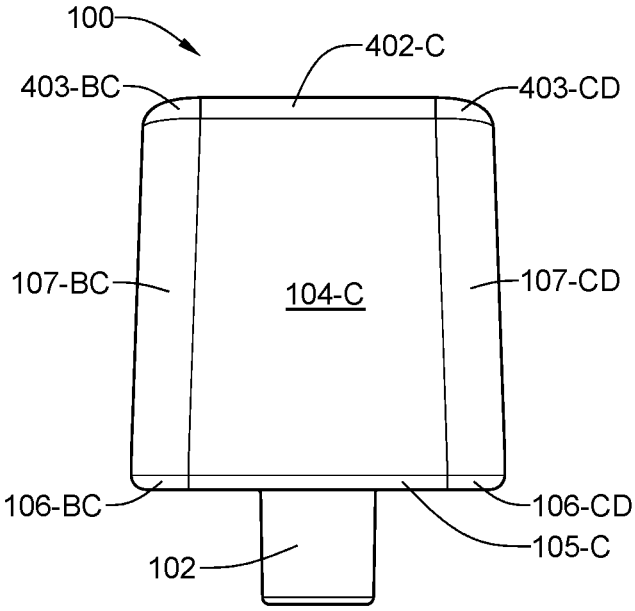
FIG. 8 is a side elevational view of the block of FIG. 1, showing the larger of the two generally rectangular side faces.
Figure 9:
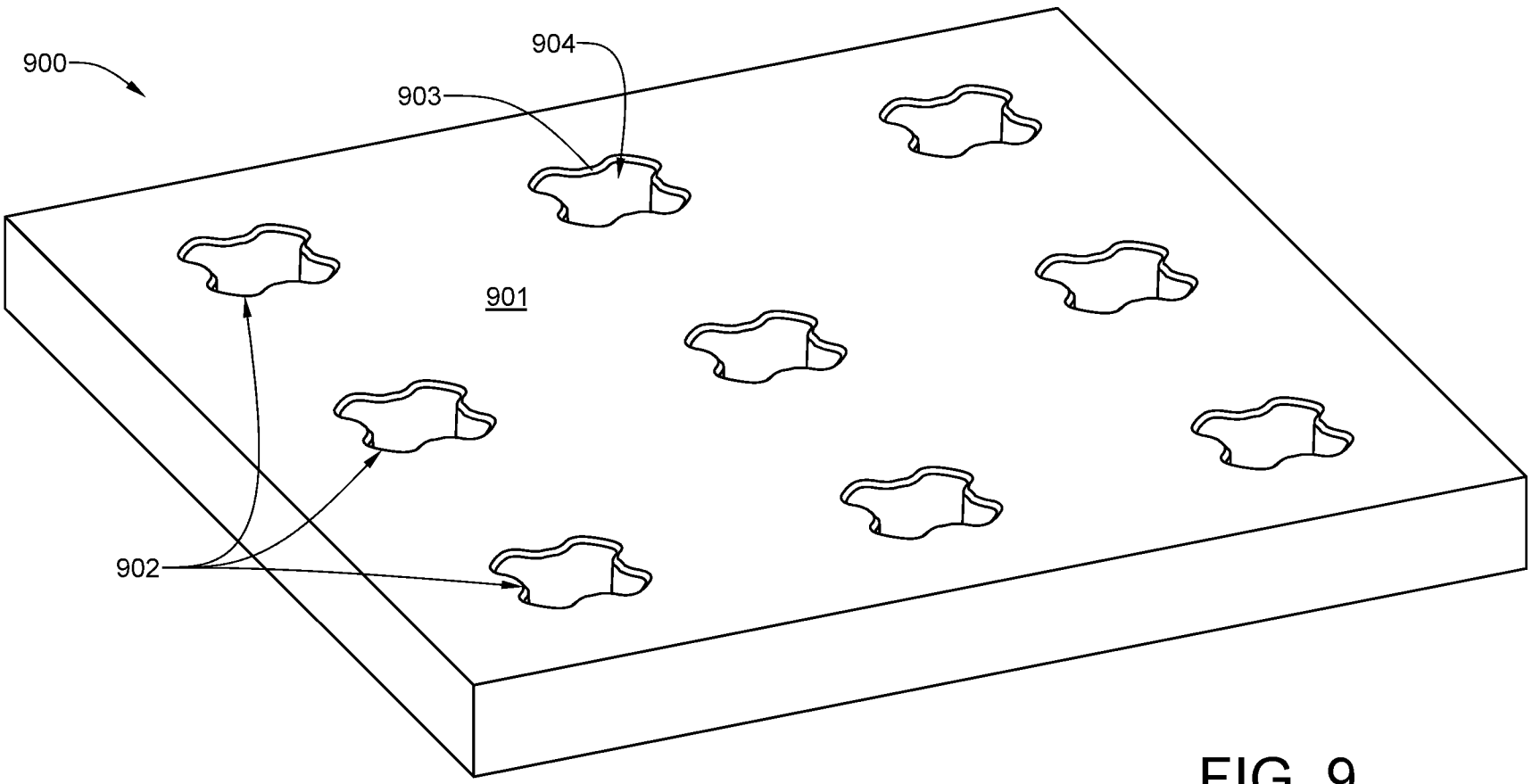
FIG. 9 is an isometric view of the pegboard.
Figure 10:
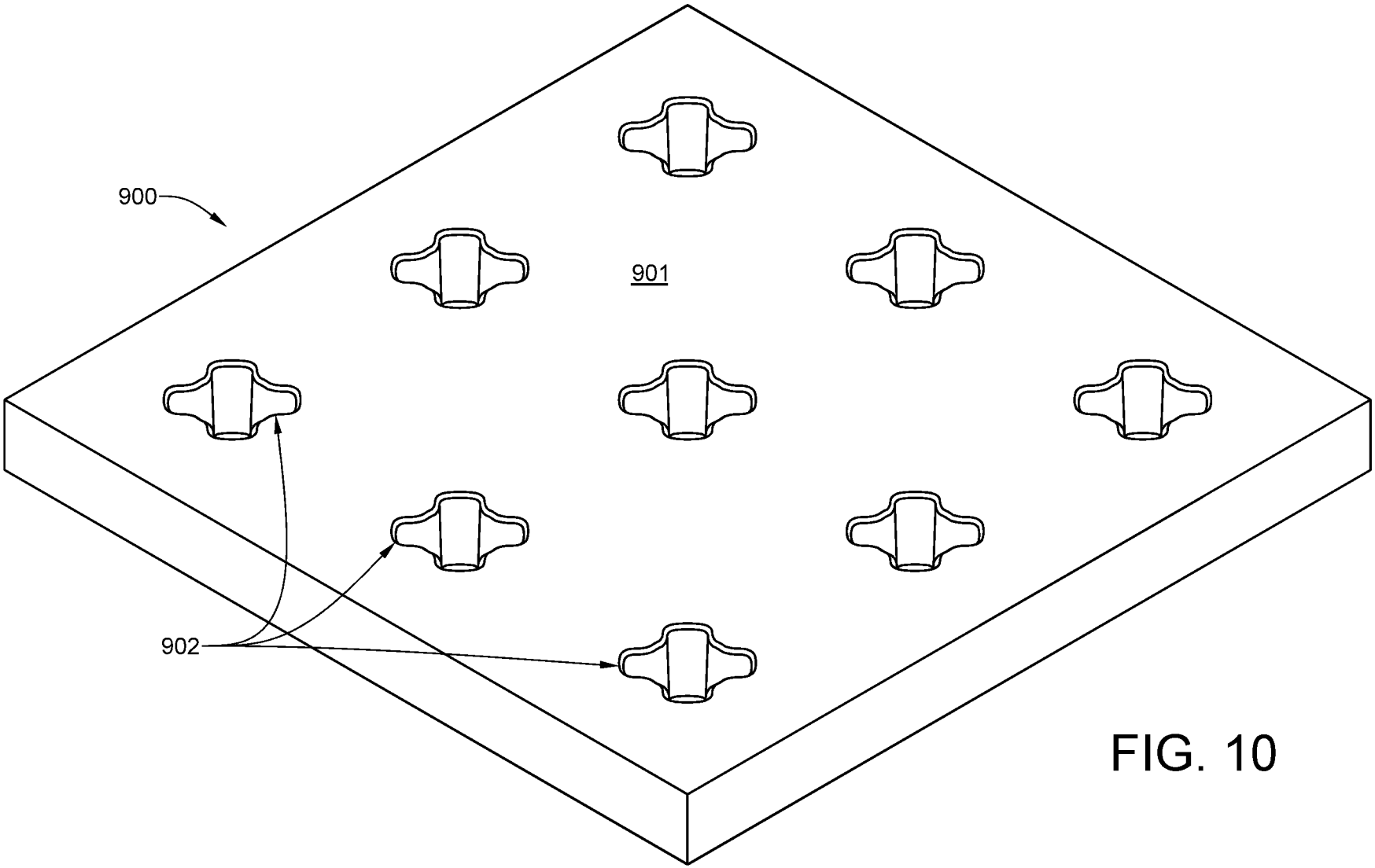
FIG. 10 is an alternative isometric view of the pegboard of FIG. 9.
Figure 11:
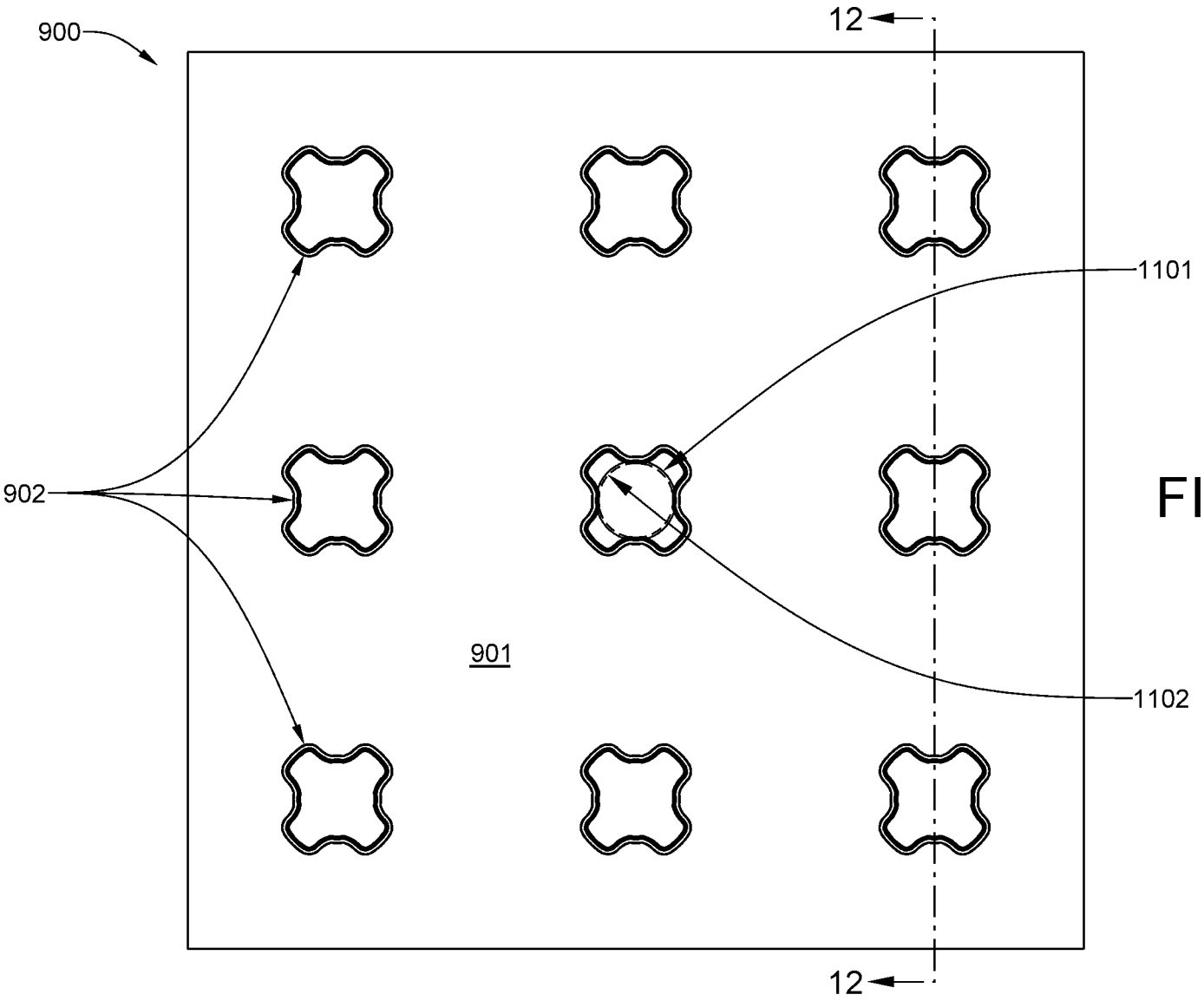
FIG. 11 is a top plan view of the pegboard of FIG. 9.
Figure 12:
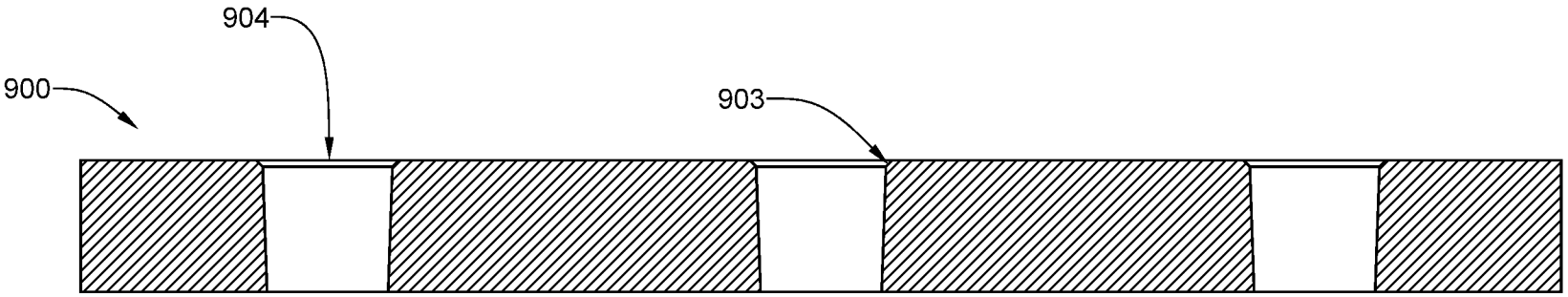
FIG. 12 is a cross-sectional view of the pegboard of FIG. 9, taken through section line 12 12 of FIG. 11.
Figure 13:
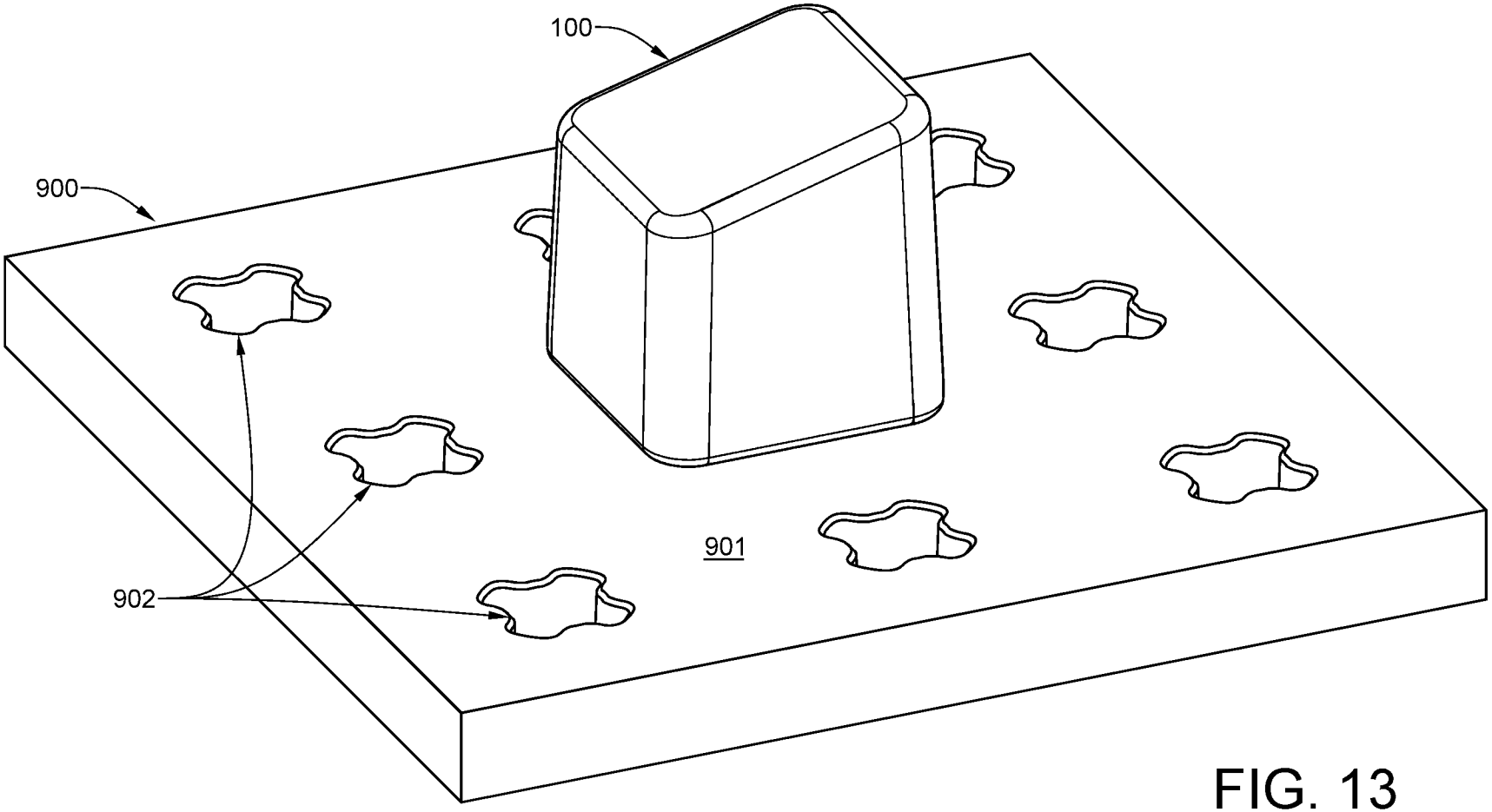
FIG. 13 is an isometric view of the surface-variable pixilated visual block display system which includes a block installed within one of the apertures of the pegboard.

The invention will now be described in detail, with reference to the attached drawing figures. Element numbers comprise three digits. The left-most digit indicates the drawing figure number where the element is first clearly visible.

Referring now to FIGS. 1 through 8, each block 100 of a plurality of blocks has six faces. A generally square base face 101 is equipped with a central peg 102 having an axis 103 that is normal to the base face 101, and that fits within any of the apertures on the pegboard 900. The base face 101 is surrounded by four intersecting quadrilateral side faces 104-A, 104-B, 104-C and 104-D. A sixth generally rectangular top face 401, which intersects the side faces, is non-parallel to the base face and elevated at an angle of 15 degrees with respect thereto. The angled top face 401 affects the visual appearance of block by interacting with light differently depending on how it is rotated. A two-degree angle is generally accepted as a standard angle for the injection molding of thermoplastic resins so that injection molded parts can be easily removed from the mold. Thus, each of the four side faces makes an angle of 88 degrees from the axis of the peg. If a cross section were to be taken of the peg through its axis, the resulting figure would be a trapezoid with 88-degree angles formed with the base face. Thus, two parallel (but for a two-degree angle per side that enables the block 100 to be removed from an injection mold), non-adjacent side faces 104-A and 104-C are generally rectangular, while the other two parallel (but for a two-degree angle per side) side faces 104-B and 104-D are trapezoidal. It is contemplated that the blocks can be colored differently. For a preferred embodiment of the invention, the intersecting edges of the faces are radiused so that an approximately quarter-round surface 402-B, which is continuous with top face 401 and side face 104-B, an approximately quarter-round surface 402-D, which is continuous with top face 401 and side face 104-D, a greater than quarter-round surface 402-C, which is continuous with top face 401 and side face 104-C, and a less-than-quarter-round surface 402-A, which is continuous with top face 401 and side face 104-A, are formed. In addition, approximately quarter-round surfaces 105-A, 105-B, 105-C and 105-D are formed at the edges of the base face 101. Corners of the block are double radiused, resulting in corners with compound-curved convex surfaces 106-AB, 106-BC, 106-CD and 106-DA, which adjoin the base face 101, and compound-curved convex surfaces 403-AB, 403-BC, 403-CD and 403-DA, which adjoin the top face. Likewise, the side edges of the block 100 are also radiused so that each block 100 can be spun about axis 103 when the peg 102 is inserted within any of the apertures on the pegboard 900 without interference from other blocks that are installed in adjacent apertures.

Referring now to FIGS. 9 through 13, a pegboard 900 has a substrate 901 with an array of equally-spaced rows and columns of apertures 902, all of which can receive a block 100. The innermost portions 905 of each aperture 902 is a curved conical section that matches the conical section of the pegs 102, thereby providing a snug fit between a peg 102 and the aperture 902. In addition, each aperture has an X-shaped cross section, which facilitates insertion of a peg 102 into the aperture 902. The edges 903 of each aperture opening 904 are chamfered, which also facilitates insertion of the pegs 102 into the apertures 902. The substrate can also be injection molded using thermoplastic resin. Another method of producing the pegboard 900 is milling it out of a solid material, such as wood or plastic. The back of the substrate 901 can have multiple wells with interconnected walls, which form webbing, in order to reduce the amount of thermoplastic resin required to mold the pegboard 900 and to minimize warping caused by uneven cooling after the molding step. Any number of pegboards can be ganged together in a planar array to make an expanded pegboard of any size. Spacing between the apertures 902 is such that each block 100 can rotate about its peg axis 103 without physically touching adjacent blocks whose side faces are either mutually perpendicular or mutually parallel. The radiused vertical edges 107-AB, 107-BC, 107-CD and 107-DA of a block 100 enable narrower spacing of the rows and columns of apertures 902 than would be possible if they were squared.

Figure 14:
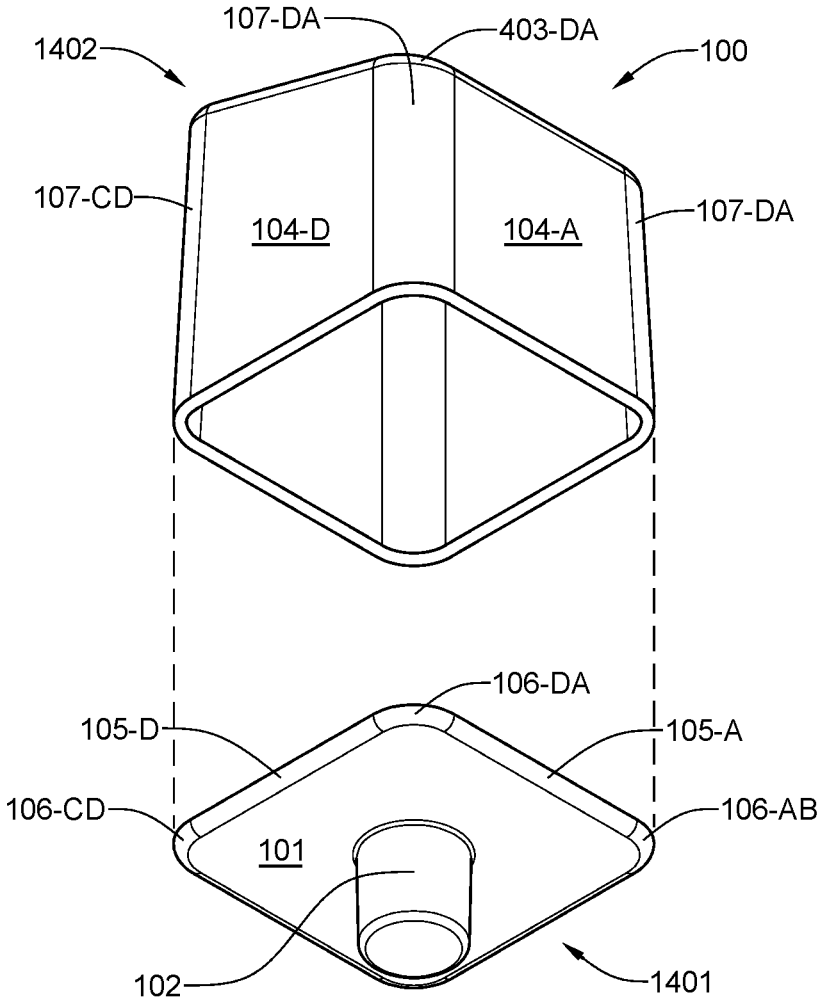
FIG. 14 is an isometric view of the block shown in two pieces before ultrasonic welding that joins the two pieces.

Referring now to FIG. 14, the simplest method to injection mold a block 100 is to mold it in two hollow pieces and ultrasonically weld the two pieces together. The first piece 1401 consists of the base face 101, the peg 102, the quarter round surfaces 105-A, 105-B, 105-C, and 105D, as well as the compound-curved convex surfaces 106-AB, 106-BC, 106-CD and 106-DA. The second piece 1402, on the other hand, consists of the remaining portions of the block 101. The easiest way to envision the two pieces is to think of a section plane perpendicular to the axis 103 that passes through the upper edges of quarter round surfaces 105-A, 105-B, 105-C and 105-D or the lower edges of faces 104-A, 104-B, 104-C and 104-D.

Another method to mold a block 100 is to by means of rotational molding. Rotational molding (also called rotomolding, rotomold or rotocasting) is a production process used to form hollow parts of limitless size. It is a cost-effective method to produce large thermoplastic items. A mold, within which thermoplastic resins have been placed, is heated and rotated slowly, both vertically and horizontally. The disadvantage to rotational molding is that the mold must be allowed to cool before the mold is opened and the molded part removed. For large, higher-value items, it is a very cost-effective method of manufacture. However, because of the cooling delay, it may not be cost effective to manufacture small, low-value items, such as the blocks, using this method.

Although only a single embodiment of the surface-variable pixilated visual block display system, it will be obvious to those having ordinary skill in the art that changes and modifications may be made thereto without departing from the scope and the spirit of the invention as hereinafter claimed.

What is claimed is:

1. A surface-variable pixilated visual block display system comprising:

a pegboard having a regular array of apertures, arranged in perpendicular rows and columns, each aperture having at least a partial conical section internal surface; and a plurality of blocks, each of which has six faces, including a generally square base face, four intersecting quadrilateral side faces and a generally rectangular top face, which intersects the side faces, said top face being non-parallel to the base face, and said base face being equipped with a central peg having a conical section exterior surface that is larger in diameter at its junction with the base face, that fits within any of the apertures, said conical section exterior surface having an axis that is normal to the base face, and mating with said at least a partial conical section internal surface to provide a snug fit between each aperture and a central peg.

2. The surface-variable pixilated visual block display system of claim 1, wherein intersecting edges of the faces are radiused and the corners of the block are double radiused.

3. The surface-variable pixilated visual block display system of claim 2, wherein the pegboard apertures are spaced so that each block can spin about the peg axis without physically touching adjacent blocks whose side faces are either mutually perpendicular or mutually parallel.

4. The surface-variable pixilated visual block display system of claim 1, wherein the top face makes an angle of about fifteen degrees with the base face.

5. The surface-variable pixilated visual block display system of claim 1, wherein each of the blocks is hollow and is formed from two injection-molded portions which are joined at an ultrasonically-welded seam between the base face and an upper portion of the block.

6. The surface-variable pixilated visual block display system of claim 1, wherein each of the blocks is hollow, having been fabricated using rotational molding.

7. The surface-variable pixilated visual block display system of claim 1, wherein blocks are a plurality of different colors.

8. The surface-variable pixilated visual block display system of claim 1, wherein the side faces of each block taper inwardly from the base face at an angle of about two degrees.

9. The surface-variable pixilated visual block display system of claim 1, wherein the peg board is produced using methods selected from the group consisting of milling and injection molding.

10. The surface-variable pixilated visual block display system of claim 1, wherein each aperture of the pegboard has an X-shaped cross section and chamfered edges at the aperture opening in order to facilitate insertion of a peg into the aperture.

11. A surface-variable pixilated visual block display system comprising:

a pegboard having a regular array of apertures, arranged in perpendicular rows and columns, each aperture having an at least partial conical section internal surface; and a plurality of blocks, each of which has six faces, including a generally square base face, four intersecting quadrilateral side faces and a generally rectangular top face, which intersects the side faces, said top face being non-parallel to the base face, and said base face being equipped with a central peg, said central peg fitting within any of the apertures, and said central peg having an axis that is normal to the base face;

wherein, on order to make the block injection moldable, each of the four side faces makes an angle of about 88 degrees with the base face, and the central peg has a conical section exterior surface that mates with said at least partial conical section interior surface to provide a snug fit between each aperture and a central peg, and each central peg is configured such that a cross section taken through the central peg axis results in an equilateral trapezoid, with each of the non-parallel sides of the trapezoid making an acute angle of about 88 degrees with the base face.

12. The surface-variable pixilated visual block display system of claim 11, wherein intersecting edges of the faces are radiused and the corners of the block are double radiused.

13. The surface-variable pixilated visual block display system of claim 12, wherein the pegboard apertures are spaced so that each block can spin about the peg axis without physically touching adjacent blocks whose side faces are either mutually perpendicular or mutually parallel.

14. The surface-variable pixilated visual block display system of claim 11, wherein the top face makes an angle of about fifteen degrees with the base face.

15. The surface-variable pixilated visual block display system of claim 11, wherein each of the blocks is hollow and is formed from two injection-molded portions which are joined at an ultrasonically-welded seam between the base face and an upper portion of the block.

16. The surface-variable pixilated visual block display system of claim 11, wherein each of the blocks is hollow, having been fabricated using rotational molding.

17. The surface-variable pixilated visual block display system of claim 11, wherein blocks are a plurality of different colors.

18. The surface-variable pixilated visual block display system of claim 11, wherein the side faces of each block taper inwardly from the base face at an angle of about two degrees.

19. The surface-variable pixilated visual block display system of claim 11, wherein the peg board is produced using methods selected from the group consisting of milling and injection molding.

* * * * *